United States Patent [19]

Coe

[11] Patent Number: 4,458,465

[45] Date of Patent: Jul. 10, 1984

[54] STRUCTURAL MEMBER

[75] Inventor: William B. Coe, Beaverton, Oreg.

[73] Assignee: Columbia Pacific Structural Components, Inc., Portland, Oreg.

[21] Appl. No.: 398,078

[22] Filed: Jul. 14, 1982

[51] Int. Cl.[3] ..... E04C 3/12

[52] U.S. Cl. ..... 52/729

[58] Field of Search ..... 52/730, 729, 723, 690, 52/697, 732, 721, 642; 403/364, 381

[56] References Cited

U.S. PATENT DOCUMENTS

| | | | |
|---|---|---|---|
| 2,448,362 | 8/1948 | Earhart | 52/729 |
| 3,991,535 | 11/1976 | Keller et al. . | |
| 4,074,498 | 2/1978 | Keller et al. | 52/730 X |
| 4,191,000 | 3/1980 | Henderson | 52/729 |
| 4,249,355 | 2/1981 | Anderson et al. . | |

FOREIGN PATENT DOCUMENTS

| | | |
|---|---|---|
| 2844799 | 10/1978 | Fed. Rep. of Germany . |
| 437720 | 8/1966 | Switzerland . |

*Primary Examiner*—John E. Murtagh

*Attorney, Agent, or Firm*—Kolisch, Hartwell, Dickinson & Anderson

[57] ABSTRACT

A structural member including a chord member and a web joined through an edge to the chord member. The web has a multi-layered laminated construction with opposite plies forming the faces thereof having grain which is perpendicular to the grain of the chord member. One face ply is thicker than the opposite face ply, and protrudes beyond the opposite face ply. A groove in the chord member having a cross-sectional profile matching the cross-sectional profile of the edge of the web receives the edge of the web.

8 Claims, 5 Drawing Figures

STRUCTURAL MEMBER

BACKGROUND AND SUMMARY

This invention relates to structural members, such as beams, wooden trusses, etc., which include a wooden chord member extending along the length of the structural member and a multi-layered laminated wooden web, such as a plywood web, joined along an edge of the web to the chord member. In a structural member such as an "I" beam, two of such chord members extend along opposite edges of the beam and the web described spans these chord members and is joined along opposite edges to each.

Generally, an object of the invention is to provide an improved construction for such a structural member which results in enhanced load-bearing characteristics in the member.

More particularly, the invention concerns a novel construction for the multi-layered laminated wooden web present in the member, and the joint of such web with the chord member, which results in improved load-bearing characteristics in the member as a whole.

A structural member or beam constructed pursuant to the invention includes what is referred to herein as a strongback layer forming one face of the web in the beam, with grain extending perpendicular to the grain of the chord member to which the web is joined. Also part of the web is another layer forming the opposite face of the web, with grain extending in the same direction, and one or more core layers or laminas with grain paralleling the grain of the chord member. The thickness of the strongback layer is greater than the thicknesses of other layers in the web having similar grain direction. Furthermore, the edge of the web, where such is joined to the chord member, is shaped so that the strongback layer protrudes beyond other layers in the web to form a ridge extending along the web's edge.

The chord member has a groove extending therealong receiving the edge of the web having a cross-sectional profile which corresponds to the cross-sectional profile of the web's edge. Thus, the groove described has a portion of greater depth receiving the ridge formed by the protruding edge of the strongback layer, and a portion of lesser depth receiving the margins of one or more intermediate core layers and the other face layer in the web. In joining the web edge to the chord member, an adhesive bond is provided over all exposed surfaces of the strongback layer as well as over portions of the opposite face layer in the web which is received within the groove of the chord member.

Preferably, the web is positioned relative to the chord member whereby a plane bisecting the chord member and paralleling the faces of the web is offset toward the strongback layer of the web from a plane paralleling the web faces which bisects the web. This offset serves to transfer a greater loading to the strongback layer in the web then were the web to be truly centered relative to the chord member.

With the construction described, a superior adhesive bond is formed between the chord member and vertical grain surfaces of the web (i.e., surfaces of the web with grain extending perpendicular to the grain of the cord member), and thus there is optimal uniting of the chord member to portions of the web which withstand deflection of the chord member with the structural member under load. There is full core integrity between various layers of the web which are joined to the strongback layer, unlike dovetail joints known in the art which have core layers terminating inwardly of opposite face layers bonded to the core layer. Webs may be constructed with the strongback layer having grain which extends perpendicular to the grain of the chord of one grade, and other layers of like grain direction of a lesser grade, with structural members produced therefrom meeting accepted industry standards, offering an opportunity for enhanced utilization of available wood supplies.

Manufacture of the structural member of the invention is performed relatively easily. The groove in the chord member which receives the edge of the web is readily prepared using conventional milling equipment. Placement of the edge of the web within the groove is a simple operation performable with little chance of inadvertent damage to the materials being handled.

These and other objects and advantages of the invention will become more fully apparent from a reading of the accompanying detailed description, which is to be taken in conjunction with the accompanying drawings, wherein:

DETAILED DESCRIPTION OF A PREFERRED EMBODIMENT OF THE INVENTION

Figure 1:
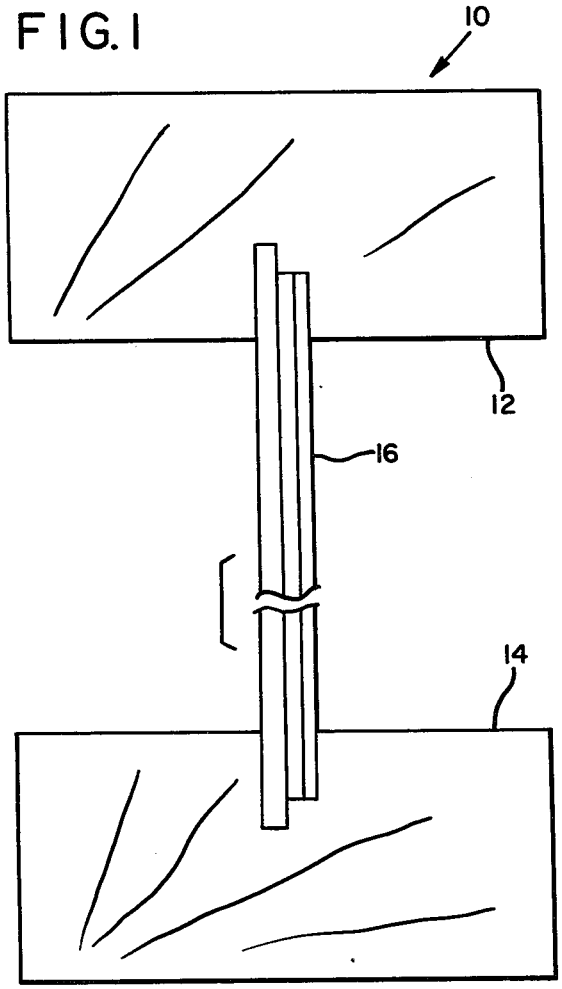
FIG. 1 is an end view of an "I" beam type structural member constructed pursuant to the invention, and illustrating the end of a web in the beam and the ends of two cord members with which the web joins.
Figure 2:
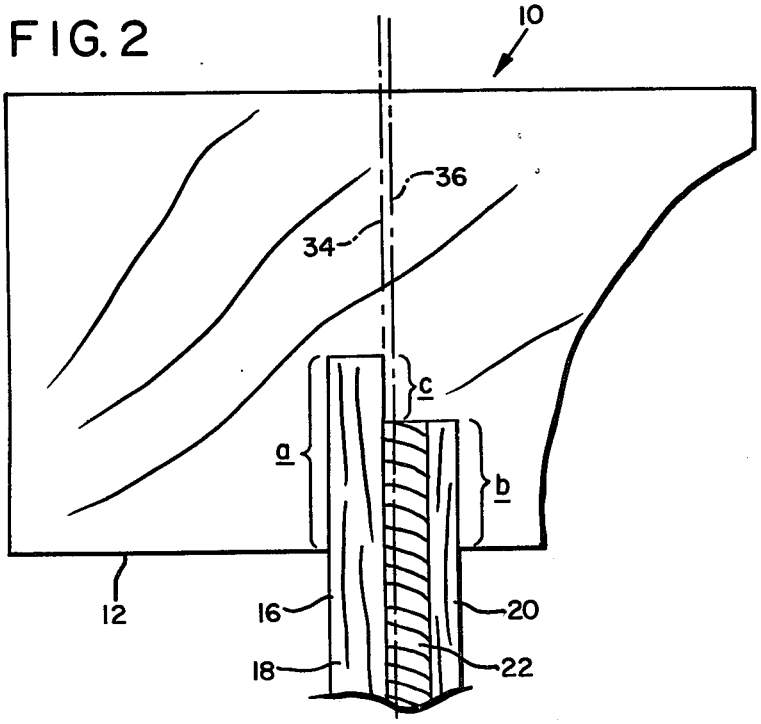
FIG. 2 is an enlarged view of portions of the end of the beam illustrated in FIG. 1.

Referring now to the drawings, and more particularly to FIGS. 1 and 2, illustrated in these figures is a structural member taking the form of an "I" beam and indicated at 10. Opposite edges of the beam are formed by chord members 12 and 14. Spanning the space between the chord members, and with an edge joined to each, is a web indicated at 16.

The general dimensions of the beam is obviously subject to variations depending upon the intended application for the beam. A typical beam having widespread application may include chord members having the width of thickness measurements roughly resembling a 2 by 4, i.e., approximately $3\frac{1}{2}$ inches by $1\frac{1}{2}$ inches. The overall depth of the beam may be expected to be approximately 6 to 30 inches. The beam would be manufactured in lengths up to 60 feet or more. The specific measurements just indicated are for purposes of illustration only.

Web 16 in the "I" beam of FIGS. 1 and 2 has a three ply construction. Specifically, such comprises a layer or ply 18 forming one face of the web, another layer or ply 20 forming the opposite face of the web, and an intermediate ply or lamina 22 forming the core of the web. The grain of chord members 12, 14 extends along the length of the members, so that the viewer of FIGS. 1 and 2 views end grain in these chord members. Layers 18 and 20 of the web have grain extending generally in the plane of the web, which is perpendicular to the grain in the chord members, referred to herein for brevity reasons as vertical grain. The grain of the intermediate layer or ply 20, which is the crossbanding ply in the web, extends across the grain in layers 16, 20 and therefore parallels the grain in the chord members, and is referred to herein for brevity reasons as horizontal grain. The various layers in the web are all bonded together by means of glue lines interposed between the layers in the manner of conventional plywood.

As perhaps best illustrated in FIG. 2, face layer or ply 18 has a thickness which exceeds the thickness of the other face layer 20 and intermediate lamina 22. This layer of greater thickness is referred to herein as a strongback layer, and the thickness of the strongback layer ordinarily exceeds the thickness of the opposite face layer by 20% or more. In a typical beam having the dimensions earlier indicated, and made from socalled "Group 1" wood species of the American Plywood Association (Douglas Fir, Western Larch, and Southern Yellow Pine), layer 18 might have a width of 0.125 inch, core lamina 22 a thickness of 0.125 inch, and face layer 20 a thickness of 0.100 inch.

It should further be noted that the edge of web 16 is formed with a margin of strongback layer 18 protruding beyond the margins or edges of the other layers in the web which are coextensive or flush with each other. In the three ply construction herein specifically being discussed, the amount of such protrusion might be expected to be approximately 3/16ths inch.

Figure 3:
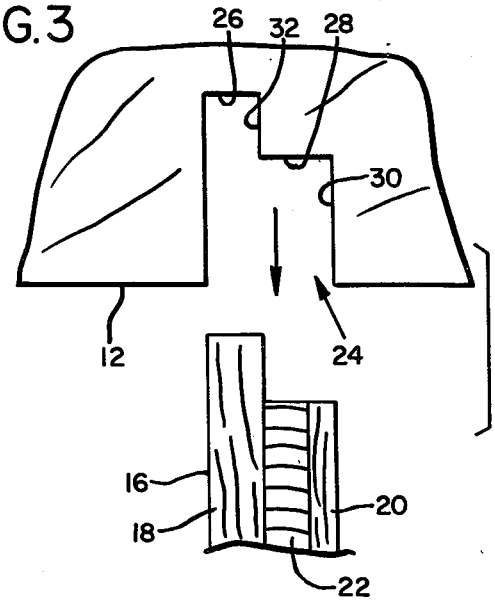
FIG. 3 illustrates portions of a chord member and marginal portions of a web prior to their being joined together.

In joining an edge of the web to a chord member, a side of the chord member is prepared with an edge-receiving groove having a cross-sectional profile conforming to the cross-sectional profile of the edge of the web which is to be received within the groove. Thus, and as can be seen in FIG. 3, a groove 24 is prepared in a side of the chord member which includes a floor 26 defining the base of part of the groove which receives the strongback layer, and a floor 28 defining the base of a shallower portion of the groove which receives the remainder of the edge of the web. The shallower portion of the groove is deep enough to receive a significant extent of margins of layers 20, 22. This results in a side wall 20 of the groove of sufficient width to provide a good bonded attachment with the face of layer 20 which ultimately becomes lodged thereagainst. In the specific example herein discussed, side wall 30 may have a width of 7/16ths inch or a width at least twice as great as the 3/16ths inch width of side wall 32.

The width of groove 24 is essentially the width of the web, which produces a snug fit with the web edge fitted in the groove. If desired, wall 32 leading from floor 28 to floor 26 may be inclined slightly, to provide a wedge fit of the ridge which is formed by the protruding edge of the strongback layer.

In preparing the joint between the edge of the web and the chord member, adhesive is applied whereby a glue line extends between all the surfaces that define the groove and all the surface expanses of the edge of the web which come up against these groove surfaces. As a result, side surface expanses within the bracket shown at a and c in FIG. 2 of the strongback layer become firmly bonded to abutting wall surfaces of the groove, and the side surface expanse within the bracket shown at b of layer 20 becomes firmly bonded to a wall expanse forming the groove. This is in addition to the bond which exists between end surfaces expanses of the edge with floor portions of the groove.

By reason of the greater thickness of the strongback layer, and the substantial expanses of the side surfaces of this layer which are bonded to the walls forming the groove, it has been found preferably to offset the position of the web with respect to a plane bisecting the chord member, whereby a somewhat greater loading is imparted to the strongback layer when a vertical load is applied to the beam. Thus, it will be seen, and with reference to FIG. 2, that the plane which bisects the chord member and parallels the opposed faces of the web, shown at 34, is offset toward the strongback layer from a plane which parallels the web faces and which bisects the web, such as plane 36.

In the completed "I" beam or structural member, vertical grain surfaces in the web (vertical grain material best withstanding the sheer stresses resulting when the beam is deflected under load) are adhered over a substantial area to wall surfaces of the groove. Such vertical grain surfaces include surfaces on opposite sides of the strongback layer, by reason of such layer's protrusion above the rest of the layers in the web. Industry standards that dictate the use of a uniform grade of veneer in the face layers, such as the C grade that the American Plywood Association specifies in connection with the Group 1 species of wood earlier discussed, meet acceptance following the invention with the use of a C Grade in the strongback layer and a lesser grade, such as D Grade, in the other face layer, or layer 20. The intermediate ply or lamina 22 extends into the groove as far as layer 20, and where imbedded in the groove is bonded throughout to the layers abutted thereagainst. Thus, there is full core integrity existing between outer layer 20 and the strongback layer 18, with the beneficial crossbanding effect that such produces. No gap exists at the core in the region where the web initially enters the chord member, as results where the core edge is recessed to produce in the protruding face layers on either side a dovetail configuration. A uniform transfer of load occurs from the upper chord member to the lower cord member by way of the web which spans the distance between the two chord members.

A significant feature of the invention is the offset of the plane which bisects the chord member, shown at 34 in FIG. 2, toward the strongback layer from a plane which parallels the web faces and bisects the web, such being shown in FIG. 2 at 36. As already indicated, the strongback layer has a greater width than the opposite face layer, i.e., the other layer in the web which has grain extending in the same direction as the strongback layer. Furthermore, the strongback layer, has at least the quality, i.e., grade of the opposite face layer. Under these circumstances, by reason of the greater width of the strongback layer, such strongback layer has greater resistance to shear than the opposite face layer. Thus, the offset may also be expressed by saying that the plane which bisects the chord member is offset toward the layer in the web which has the greatest shear resistance from a plane which parallels the web faces and which bisects the web.

Figure 4:
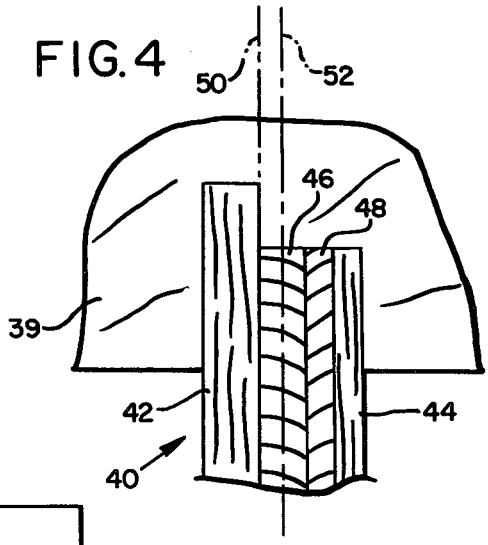
FIG. 4 illustrates portions of a chord member and marginal portions of a web pursuant to a modification of the invention.

In FIG. 4 there is illustrated a modified form of the invention. In the FIG. 4 modification, web 40 is made up of four layers, namely strongback layer 42, opposite face layer 44, and two intermediate core plys or laminas 46, 48. The layers 42, 44 forming the faces of the web have vertical grain, and the intermediate core laminas have horizontal grain. The strongback layer has a thickness exceeding that of the other face layer, and in a typical instance, strongback layer 42 may have a thickness of 0.125 inch, face layer 44 a thickness of 0.100 inch, and layers 48 and 46 thicknesses of 0.100 and 0.125 inch, respectively. Again, as discussed in connection with the first modification of the invention, preferably the web is offset, whereby the plane 50 which bisects the chord member is offset toward the strongback layer from the plane 52 which bisects the web. As in the case of the first modification of the invention, the strongback layer is bonded over surface expanses extending along opposite sides of the layer to surfaces in the groove receiving the edge of the web. There is full core integrity between layer 44 and layer 42, and an even transmission of load from chord member 39 through the web to the chord member which forms the other edge of the "I" beam.

Figure 5:
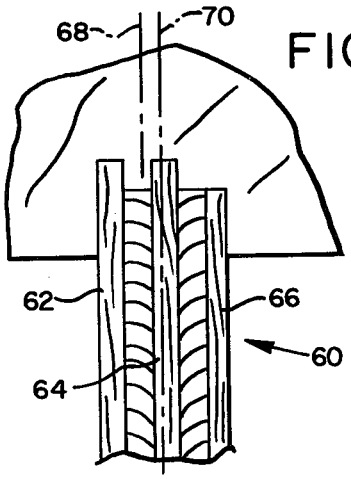
FIG. 5 is a view similar to FIG. 4 but illustrating yet another modification of the invention.

FIG. 5 illustrates incorporation of the invention with a five ply web. Referring to FIG. 5, web 60 includes two strongback layers, 62, 64 having vertical grain, strongback layer 62 being a face layer. Layer 66 forming the other face layer and also having vertical grain has a thickness reduced from the thickness of layers 62, 64. As in the case of the first embodiment of the invention discussed, the strongback layers protrude into the chord member a greater distance than do the other layers which are coextensive with each other. Full core integrity exists between face layer 66 and remaining layers in the web. Preferably the web is offset whereby plane 68 which bisects the chord member is located toward the strongback face layer in the web from plane 70 which bisects the web.

It should be obvious from the above description and illustrative examples that a structural member such as a beam is contemplated having a number of unique and desirable features and advantages over constructions known to date. While certain modifications of the invention have been discussed, it should further be obvious that various modifications and alterations of the invention are possible without departing from the invention, and it is intended to cover all such modifications and variations as would be apparent to one skilled in the art.

It is claimed and desired to secure by Letters Patent:

1. In a structural member which includes a multi-layered laminated wooden web joined along an edge to an elongate wooden chord member having grain extending along the length of the member, a construction for said web which comprises a strongback layer forming one face of the web with grain extending perpendicular to the grain of the chord member, another layer forming the opposite face of the web with grain extending in the same direction and having a thickness reduced from the thickness of the strongback layer and lesser shear resistance than the strongback layer, and at least one intermediate core lamina with grain paralleling the grain of the the chord member disposed between the layers forming the faces of the web, said edge of the web being formed with said strongback layer protruding beyond said other face layer and intermediate core lamina to form a ridge along said edge, said chord member having an edge-receiving groove formed along the length thereof with a profile conforming to the profile of the edge of the web and thus including a portion of one depth receiving the core lamina and outer face layer and a portion of greater depth receiving said strongback layer, said edge of the web seating within said groove with surface expanses of said edge including opposite surface expanses of said ridge against surface expanses of said groove, and an adhesive bond joining surface expanses of said edge with surface expanses of said groove.

2. The structural member of claim 1, wherein the web is positioned relative to said chord member whereby a plane bisecting said chord member and paralleling the faces of the web is offset toward said strongback layer from a plane paralleling said faces which bisects said web.

3. The structural member of claim 1, wherein the web consists of said strongback layer, said other layer, and a single intermediate core lamina, and the web is positioned relative to said cord member whereby a plane bisecting said cord member and paralleling the faces of the web is offset toward said strongback layer from a plane which parallels said faces which bisects said web.

4. The structural member of claim 1, wherein the wooden web consists of said strongback layer and said other layer, and two intermediate core laminas, said strongback layer protruding beyond both core laminas.

5. The structural member of claim 1 consisting of the strongback layer forming one face of the web and the other layer forming the opposite face of the web and an intermediate core lamina as recited in claim 1, another intermediate core lamina and another strongback layer, said other strongback layer being separated from the first-mentioned strongback layer by one of said intermediate core laminas and from said other layer by the other of said core laminas, said edge of the web being formed with both of said strongback layers protruding as recited in claim 1 to form ridges extending along the edge of the web.

6. A structural beam including a web joining with a chord member, said chord member being an elongate wooden piece and having grain extending along the length thereof, said web being a segment of three-ply plywood and including an outer strongback ply forming one face of the web with grain extending perpendicular to the grain of the chord member, an intermediate core ply with one side thereof bonded to the strongback ply and having grain paralleling the grain of the chord member, and another outer ply forming the opposite face of the web bonded to the other side of the core ply and with the grain thereof perpendicular to the grain of the chord member, said other ply having lesser thickness and lesser shear resistance than the thickness and shear resistance of said strongback ply, said chord member having a groove extending along the length thereof receiving an edge of said web, said edge of the web being formed with said strongback ply protruding beyond the other plies which have flush edges whereby a ridge is formed by said strongback ply with opposite surfaces of the strongback ply being exposed along the expanse of said ridge, said groove having a profile conforming to the profile of the edge of said web, and an adhesive bond joining the edge of the web where such is received by said groove which includes a bond extending over said exposed opposite surfaces of said strongback ply where such extends as a ridge.

7. A structural beam comprising:

an elongate wooden chord member having grain extending along its length, and a web joined along an edge thereof to said chord member, said web having a strongback ply forming one face and another ply forming the opposite face of the web, said plies having grain extending perpendicular to the grain of the chord member and said strongback ply having greater thickness and greater shear resistance than the other ply, said web including at least one intermediate ply between the plies forming the face of the web with grain paralleling the grain of the chord member, the plies in the web being adhesively bonded together, said strongback ply protruding beyond the said other and said intermediate plies at said edge, said chord member having a groove extending along the length thereof receiving said edge of the web which groove includes a portion of one depth receiving said protruding strongback ply and a portion of lesser depth receiving the other ply and said intermediate ply, the surfaces of said edge of the web being adhesively bonded to the surfaces forming said groove.

8. In a structural member, an elongate wooden chord member having grain extending along the length of the member, and a multi-layered laminated wooden web joined along an edge to said chord member, said web comprising one layer forming one face of the web with grain extending perpendicular to the grain of the chord member, another layer forming the opposite face of the web with grain extending in the same direction, and at least one intermediate core lamina with grain paralleling the grain of the chord member disposed between the layers forming the faces of the web, said one layer having a shear resistance which exceeds the shear resistance of the layer forming the opposite face of the web, said chord member having an edge-receiving groove extending along the length thereof and said edge of the web seating within said groove and an adhesive bond joining surface expanses of said edge with surface expanses of said groove, the web being positioned relative to said chord member whereby a plane bisecting the chord member and paralleling the faces of the web is offset toward said one layer having greater shear resistance from a plane paralleling said faces which bisects said web.

* * * * *